US006691720B2

(12) United States Patent
Bergman et al.

(10) Patent No.: US 6,691,720 B2
(45) **Date of Patent: *Feb. 17, 2004**

(54) MULTI-PROCESS SYSTEM WITH PIVOTING PROCESS CHAMBER

(75) Inventors: Eric Bergman, Kalispell, MT (US); Dana Scranton, Kalispell, MT (US); Eric Lund, Kent, WA (US); Gil Lund, Kent, WA (US)

(73) Assignee: Semitool, Inc., Kalispell, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/907,485

(22) Filed: Jul. 16, 2001

(65) Prior Publication Data

US 2003/0010352 A1 Jan. 16, 2003

(51) Int. Cl.[7] ..... B08B 3/00

(52) U.S. Cl. ..... 134/155; 134/159; 134/186; 134/200; 34/108; 34/184; 34/279

(58) Field of Search ..... 134/1, 1.3, 33, 134/140, 153, 155, 157, 159, 186, 200, 902; 34/58, 59, 85, 94, 108, 184, 279; 210/514, 519

(56) References Cited

U.S. PATENT DOCUMENTS

| | | | | | |
|---|---|---|---|---|---|
| 3,858,551 | A | * | 1/1975 | Kobayasi | 118/64 |
| 3,943,637 | A | | 3/1976 | Hanser | 34/56 |
| 4,318,749 | A | | 3/1982 | Mayer | 134/25.4 |
| 4,456,022 | A | * | 6/1984 | Roberts | 134/99.1 |
| 4,596,636 | A | * | 6/1986 | Lucas | 205/211 |
| 4,813,154 | A | | 3/1989 | Ronning | 34/25 |
| 5,022,419 | A | * | 6/1991 | Thompson et al. | 134/102.1 |
| 5,074,057 | A | | 12/1991 | Kanai | 34/179 |
| 5,095,927 | A | * | 3/1992 | Thompson et al. | 134/102.1 |
| 5,154,199 | A | * | 10/1992 | Thompson et al. | 134/111 |
| 5,221,360 | A | * | 6/1993 | Thompson et al. | 134/33 |
| 5,230,163 | A | | 7/1993 | Lease | 34/57 A |
| 5,271,165 | A | | 12/1993 | Nguyen | 34/164 |
| 5,287,633 | A | | 2/1994 | Sachs | 34/13 |
| 5,513,446 | A | | 5/1996 | Neubauer et al. | 34/397 |
| 5,660,517 | A | | 8/1997 | Thompson et al. | 414/217 |
| 5,664,337 | A | | 9/1997 | Davis et al. | 34/58 |
| 5,740,617 | A | | 4/1998 | Rittenhouse | 34/381 |
| 6,076,279 | A | | 6/2000 | Saalasti | 34/397 |
| 6,125,863 | A | * | 10/2000 | Bexten | 134/95.2 |
| 6,346,126 | B1 | | 2/2002 | Chao et al. | 8/149.2 |

* cited by examiner

*Primary Examiner*—Randy Gulakowski
*Assistant Examiner*—Joseph Perrin
(74) *Attorney, Agent, or Firm*—Perkins Coie LLP

(57) ABSTRACT

A system for processing a workpiece includes an inner chamber pivotably supported within an outer chamber. The inner chamber has an opening to allow liquid to drain out. A motor pivots the inner chamber to bring the opening at or below the level of liquid in the inner chamber. As the inner chamber turns, liquid drains out. Workpieces within the inner chamber are supported on a holder or a rotor, which may be fixed or rotating. Multi processes may be performed within the inner chamber, reducing the need to move the workpieces between various apparatus and reducing risk of contamination.

37 Claims, 4 Drawing Sheets

MULTI-PROCESS SYSTEM WITH PIVOTING PROCESS CHAMBER

FIELD OF INVENTION

The invention relates to surface preparation of a workpiece, such as silicon or gallium arsenide wafers, flat panel displays, mask reticles, rigid disk media, thin film heads, or other substrates on which electronic, optical, or micro-mechanical components have or can be formed, collectively referred to here singly as a "workpiece".

BACKGROUND OF THE INVENTION

Surface preparation, such as cleaning, etching, and stripping, is an essential and important element of the manufacturing process for semiconductor wafers and similar workpieces. Surface preparation steps are commonly performed, using liquid corrosive, caustic, or solvent chemicals, or using vapor phase chemicals. Surface preparation of workpieces is performed to prepare or condition the surface for a subsequent process step.

Cleaning is a critical step in manufacturing semiconductors and similar products. Cleaning involves the use of chemical formulations to remove contaminants, such as oxides, particles, metals, or organic material, while maintaining the cleanliness and integrity of the surface of the workpiece. Some liquid, gas or vapor phase chemicals when applied to a workpiece, result in surface characteristics that are more susceptible to contamination than others. For example, application of hydrofluoric acid (HF) to the surface of a workpiece will remove oxide from the silicon surface, resulting in a surface that is active. Workpieces in general, and especially workpieces having an active surface, are constantly susceptible to contamination by airborne microscopic particles. Contamination can also occur in the cleaning process, when the liquid process media is removed from the surface of the workpiece.

Thus, to minimize contamination of the workpiece, it is advantageous to perform a sequence of surface preparation steps within a controlled environment, that preferably occupies a relatively small amount of fabrication facility space, and in which exposure to contamination sources is minimized. Accordingly, it is an object of the invention to provide improved surface processing methods and apparatus.

Cleaning workpieces while avoiding or minimizing contamination has long been an engineering challenge. Workpieces are often cleaned with a spray or bath of de-ionized water. The water is then removed, often in the presence of an organic solvent vapor, such as isopropyl alcohol, which lowers the surface tension of the water. This helps to prevent droplets of water from remaining on and contaminating the workpiece.

Various cleaning methods and systems and various rinsing and drying methods and apparatus have been proposed and used. In a typical system, wafers are immersed in a vessel. A mechanism is provided to hold the wafers. Another mechanism is provided to lift the wafers out of the liquid, by pushing them up from below. While this technique has been used, it can result in trapping of liquid in or around the spaces where the wafers contact the holding mechanism, resulting in increased contamination. It is also complicated by the need for the lifting mechanism. In an alternative system, the wafers are held in a fixed position while the liquid is drained away from below. This technique has less tendency for trapping liquid. However, as the liquid level drops, the solvent vapor above the liquid is absorbed by the liquid. Consequently, the top sections of the wafer are exposed to liquid which is different from the liquid at the bottom sections of the wafers. This potentially results in non-uniform processing. Accordingly, while these and other techniques have been used with varying degrees of success, there is still a great need for improved systems and methods for cleaning workpieces.

It is therefore also an object of the invention to provide an improved system and method for cleaning workpieces.

SUMMARY OF THE INVENTION

To this end, in a first aspect, surface preparation processes on a workpiece or workpieces are performed within a single apparatus. This minimizes exposure of the workpiece to contaminants and provides an improved application of process fluids or media to the workpiece.

In a second aspect, an apparatus has a rotor rotatably supported within a process chamber. The process chamber can pivot to move a drain outlet in the process chamber down to the level of the liquid contained in the chamber. The liquid then drains out of the chamber through the outlet. The process chamber provides for containment of process fluid. An optional second or outer containment chamber provides for containment and disposal of process fluid, and for isolating the process environment from the ambient environment, human operators, and adjacent parts and equipment. This minimizes exposure of the workpiece to contaminants and provides an improved application of process fluids or media to the workpiece.

In a third aspect, an inner chamber has a drain opening to allow process fluid to be removed from the inner process chamber. A drive motor pivots the inner process chamber at a controlled rate to bring and then maintain the opening at or below the level of the fluid in the inner chamber. The fluid then drains out from the drain opening. The drive motor may move the inner process chamber by magnetic forces, without an actual physical penetration of or connection into the process environment by a drive shaft. Optionally, the inner process chamber may be connected to the drive motor with a drive shaft, with a shaft seal sealing the shaft opening into the inner process chamber.

In a fourth aspect, the inner process chamber forms a closed chamber, without any drain opening. The workpieces remain stationary, during at least one process step, and a drive motor spins the inner process chamber around the stationary workpieces. Openings or spray nozzles on or in the inner process chamber supply a fluid onto the workpieces. To remove liquid from the chamber, the chamber is turned to or braked to a stop at a position where one or more drain ports are at a bottom position. The drain ports are then opened and the liquid drains out through them via gravity. A gas may be provided into the inner process chamber during draining, to prevent creation of a vacuum slowing or stopping the out flow of liquid. Liquid may alternatively be removed by opening the drain ports and then positioning and maintaining the drain ports at or below the liquid surface by slowly pivoting the inner process chamber, as in the third aspect described above. This allows for controlled removal of liquid, resulting is less potential for contamination of the workpieces.

In a fifth aspect, the inner chamber is closed or sealed and remains stationary and the workpieces spin within the inner chamber. This minimizes exposure of the workpiece to contaminants and provides an improved application of process fluids to the workpiece.

In a sixth aspect, sonic energy, such as ultrasonic or megasonic energy, is applied to the workpiece, preferably through liquid in which the workpiece is immersed. This improves processing as the sonic energy contributes to the processing along with the chemical reactions of the process liquids.

In a seventh aspect, the outer containment chamber is purged with a gas and/or vapor to maintain a desired environment around the workpiece. The gas or vapor may be nitrogen, or argon, or hydrofluoric acid (HF).

In an eigth aspect, unique methods for cleaning a workpiece are provided. These methods solve the problems of the known methods now used in the semiconductor manufacturing industry. Workpieces are held in a rotor within a process chamber having a drain outlet or slot. The workpieces are immersed in liquid within the process chamber. Liquid is preferably continuously supplied into the chamber so that liquid is continuously overflowing and running out of the drain outlet. The process chamber is pivoted to move the drain outlet down in a controlled movement, to lower the level of liquid in the chamber. Liquid supply to the chamber and overflow at the liquid surface preferably continues as the chamber pivots and the liquid level drops. This process continues until the liquid level drops below the workpieces and the chamber is pivoted to drain virtually all liquid out of the chamber.

By maintaining the overflow at the liquid surface, and by maintaining a constant flow towards and out of the drain outlet, impurities at the liquid surface flow away from the workpieces, reducing potential for contamination. The liquid in the chamber remains uniform at all depths, as the surface of the liquid which the solvent vapor dissolves into, is constantly being replaced with fresh liquid. After the liquid is removed from the chamber, the workpieces are advantageously rotated. Liquid droplets remaining on the workpieces or adjacent components of the apparatus are centrifugally removed. Consequently, cleaning is provided with a uniform liquid bath and with reduced potential for trapped or residual liquid remaining on the workpieces. The disadvantages associated with the machines and methods currently in use, as described above, are overcome.

The aspects of the invention described above provide greatly improved processing and cleaning apparatus and methods. These aspects help to provide more reliable and efficient processing.

Further embodiments and modifications, variations and enhancements of the invention will become apparent. The invention resides as well in subcombinations of the features shown and described. Features shown in one embodiment may also be used in other embodiments as well.

BRIEF DESCRIPTION OF THE DRAWINGS

In the drawings, wherein the same reference number indicates the same element, throughout the several views.

DETAILED DESCRIPTION OF THE DRAWINGS

Figure 1:
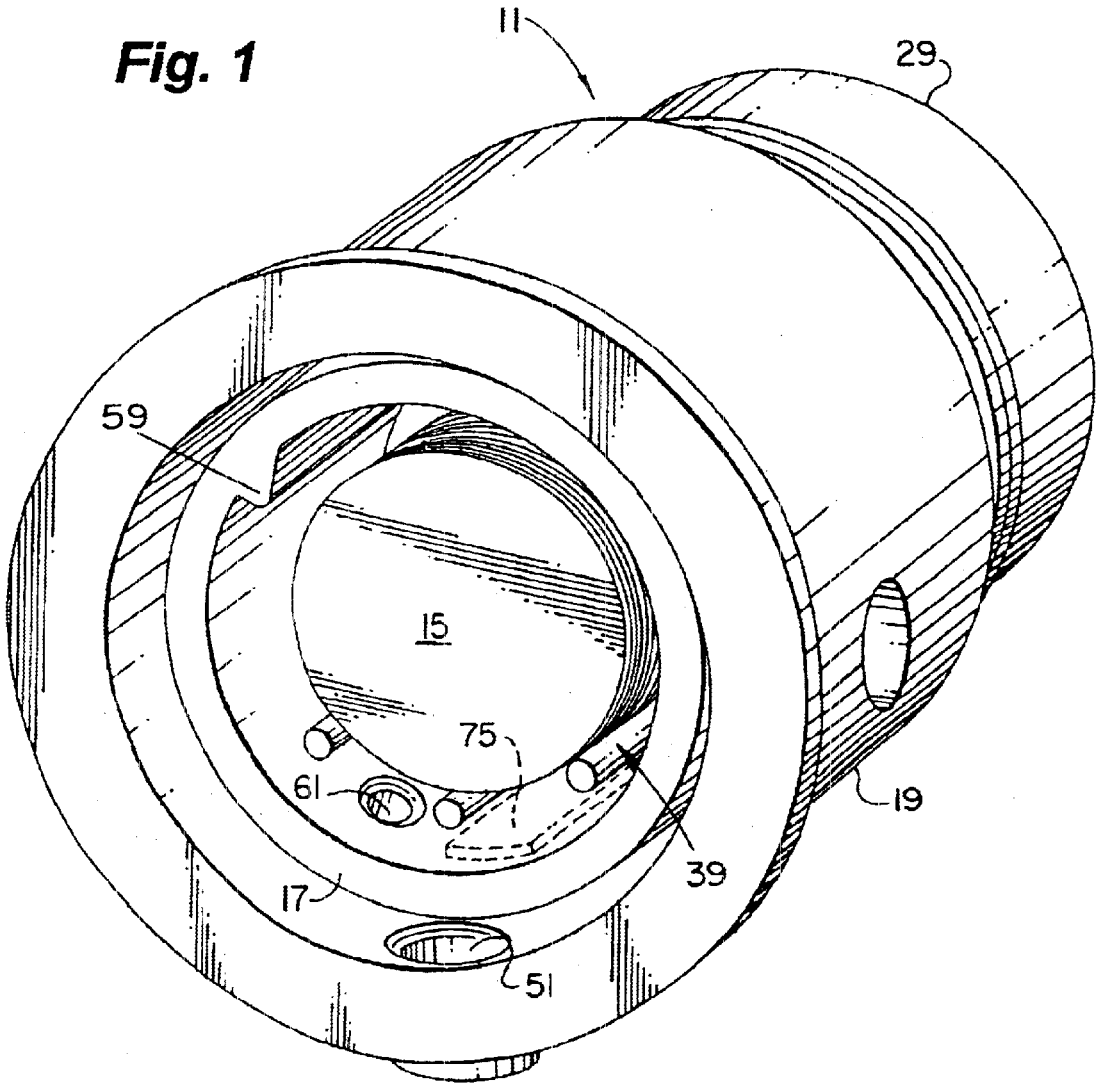
FIG. 1 is a perspective view of a surface processing apparatus having an inner process chamber moved to a position to contain fluid for full or partial workpiece immersion processing. The fluid is omitted from this view to more clearly show the components of the apparatus.

Turning now in detail to the drawings, as shown in FIG. 1, a surface processing system 11 is provided for processing flat workpieces, such as semiconductor wafers 15. The apparatus or system 11 includes a process chamber 17, optionally within an outer containment chamber 19. The outer chamber 19 contains and disposes of process fluids, and isolates the process environment from the ambient environment, human operators, and adjacent parts and equipment. The process media or fluid may include cleaning liquid such as hydrofluoric acid (HF), a rinsing liquid such as water, a gas, as nitrogen or a mixture of a gas and an organic vapor, or any combination of them. Processing of the workpieces is performed in the process chamber 17.

Figure 2:
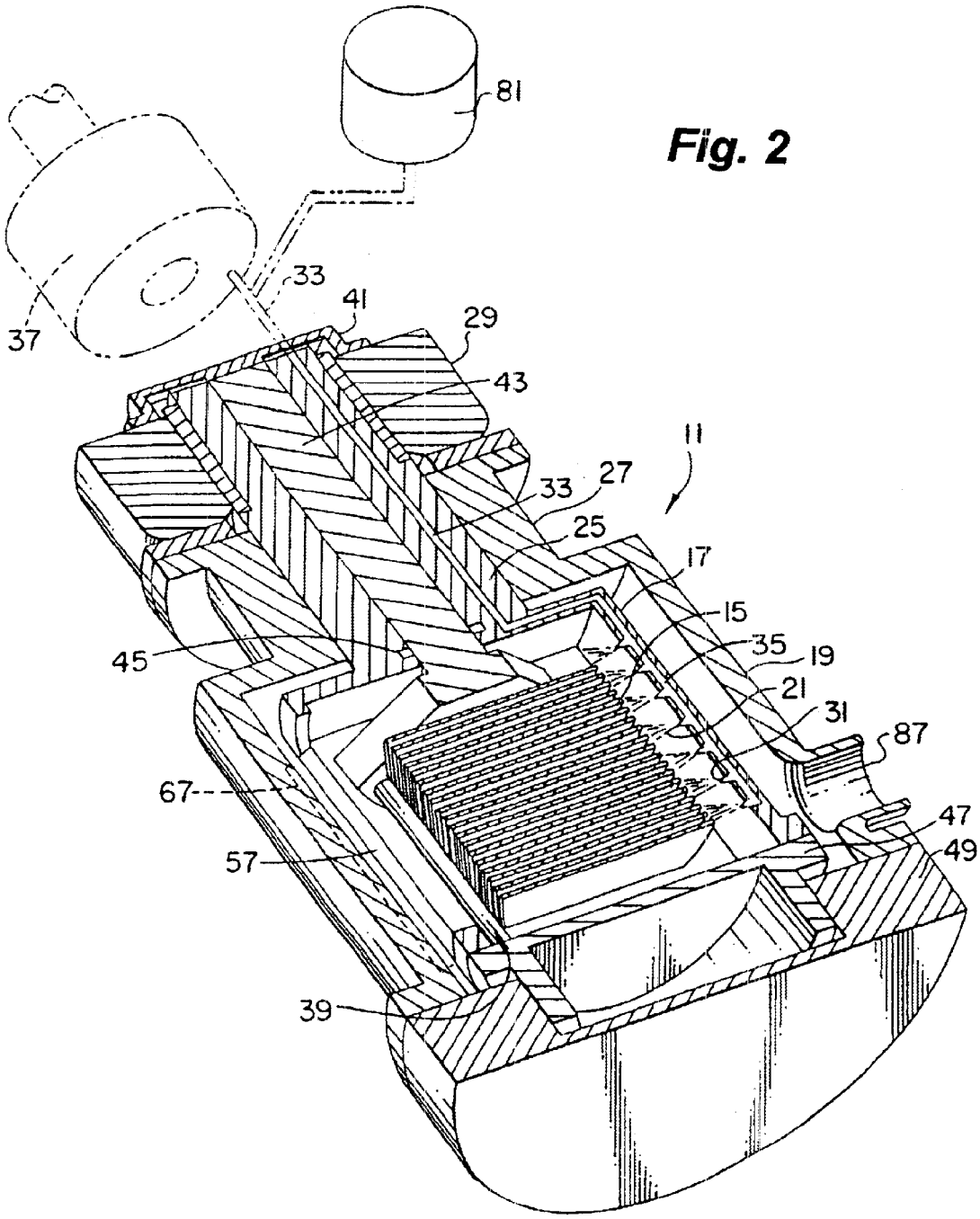
FIG. 2 is a perspective cross-sectional view of the surface processing apparatus shown in FIG. 1.
Figure 3:
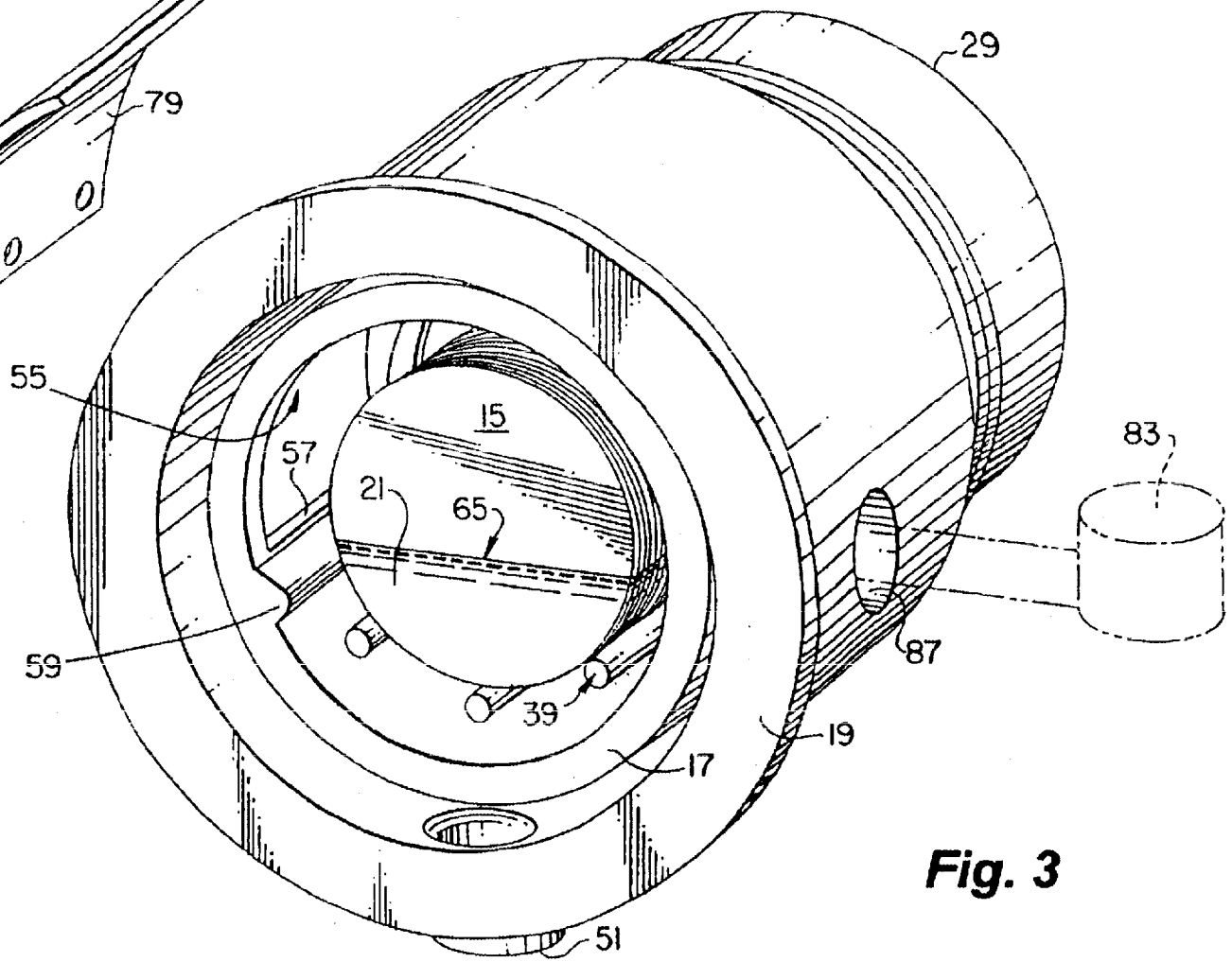
FIG. 3 is a perspective view of the apparatus of FIG. 1, with the inner chamber now moved to a position to drain out fluid.

Referring now to FIG. 2, the chamber 17 has a shaft section 25 extending rearwardly through a back section 27 of the outer chamber 19. The shaft section 25 is linked to an inner chamber drive motor or actuator 29, either by a direct mechanical linkage, or via a magnetic linkage. The motor 29 can pivot the inner chamber 17 in a relatively slow continuous and controlled movement. The motor 29 can also spin the inner chamber 17. The motor 29 can also pivot the inner chamber 17 to a desired angular orientation or position, and hold the chamber 17 in that position. The inner chamber 17, as shown in FIG. 3, has a cylindrical sidewall having a drain opening, slot, or window 55 for removing liquid from the chamber. A drain edge 57 defines the lower end of the opening 55. The drain edge 57 is preferably horizontal, and runs substantially over the entire length of the inner chamber 17. A protrusion 59 may extend below the drain edge. Pivoting here means less than 360° movement. In contrast, rotating or spinning here means sustained 360° plus movement.

The inner chamber 17 preferably contains at least one outlet 31 such as a nozzle, for delivering process fluid 21 by spray or other technique to the workpieces 15. The nozzle or outlet 31 may be above or below, or to one side of the workpieces 15, so that the process fluid 21 can travel vertically up or down, or horizontally. At least one channel or pipeline 33 delivers process fluid 21 to the nozzle or outlet 31. One or more manifolds 35, each having an array of outlets or nozzles may be used. In an embodiment where the inner chamber 17 spins, the pipeline or base 33 is connected to a rotary fluid coupling 37 or similar device within or outside of the apparatus as shown in FIG. 2.

Referring now to FIGS. 1 and 2, a rotor or workpiece support 39 for holding the workpieces 15 is positioned with the chamber 17. Preferably, the rotor 39 has grooves, typically equally spaced apart, for holding the workpieces 15. A rotor drive motor 41 is linked to a shaft section 43 of the rotor 39 extending through the shaft section 25 of the inner chamber 17. Alternatively, the rotor 39 may be linked to the motor 41 with a magnetic coupling.

The rotor 39 may alternatively have features for holding workpieces 15 within a carrier or cassette. In either case, the rotor 39 has retainers for holding the workpieces in place, for example, as descried in U.S. patent application Ser. No. 09/735,154 incorporated herein by reference.

If used, the magnetic couplings connect the rotor 39 and rotor drive 41, and the chamber actuator 29 and the chamber 17, respectively, by magnetic force, without an actual physical connection or penetration of the chamber 17 by a drive shaft. Hence, the space within the chamber 40 may be better closed or sealed against contaminants.

Figure 4:
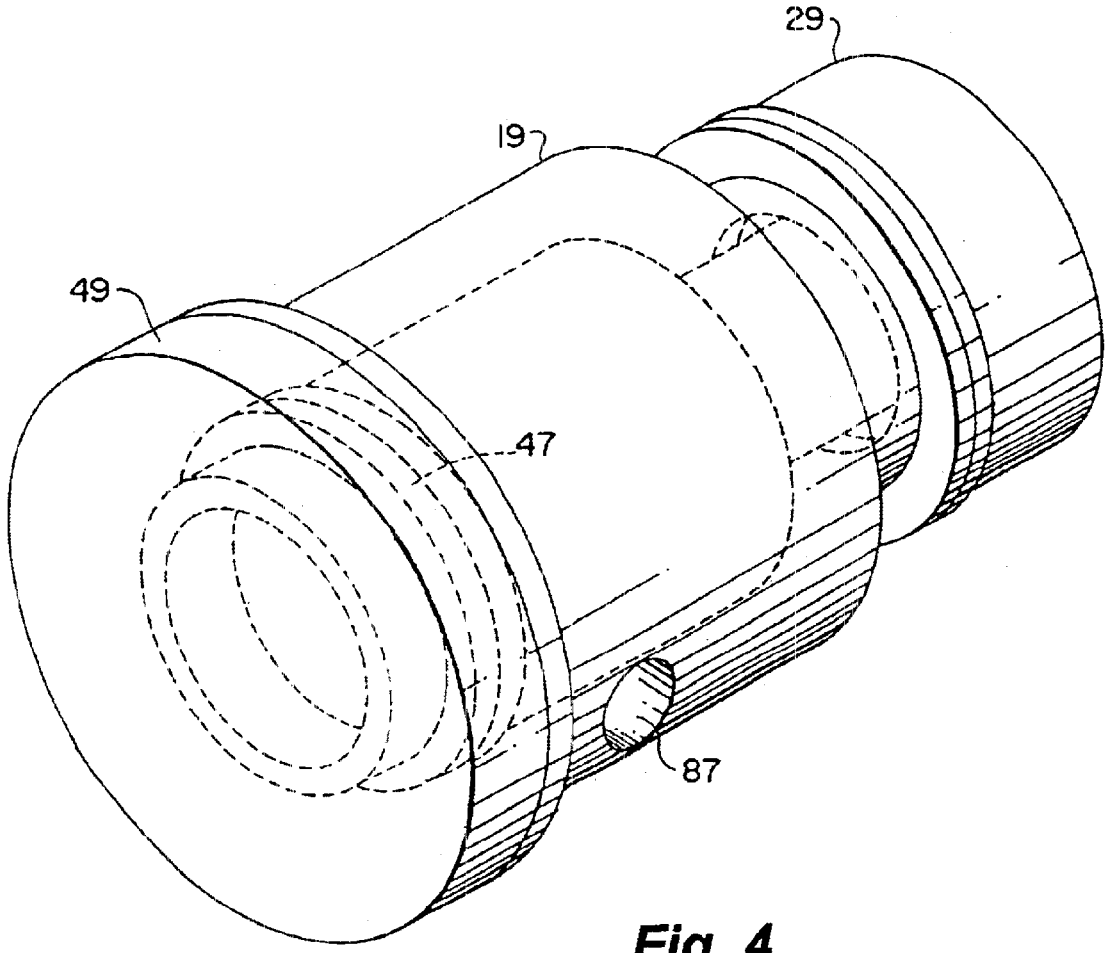
FIG. 4 is a perspective view of the apparatus of FIGS. 1–3, with the inner process chamber door and the outer containment chamber door installed and closed.

Referring once again to FIGS. 2 and 4, the chamber 17 has a door 47, for containment of the process liquid 50 within the chamber 17. The outer chamber 19 similarly has an outer door 49. With the door 49 closed, the outer chamber 19 isolates the workpieces 15 from contaminants in the environment outside of the outer chamber 19. The outer chamber 19 has one or more outlets 51 for removing fluids.

In use, the rotor 39 may be extended out of the inner chamber 17 through the open doors, by hand or with a robot. Workpieces 15 may then be loaded into the rotor 39. With the rotor loaded with one or more workpieces, the doors 47 and then 49 are closed, preferably, but not necessarily, providing fluid tight and/or gas tight seals. With the doors closed, the chamber 17, within the preferably closed or sealed outer chamber 19, provides an entirely closed off space or environment.

Various process steps may then be performed. For immersion processes, process fluid is pumped into the chamber 17 from one or more openings or nozzles 31 via the supply line(s) 33. The inner chamber 17 can pivot about a longitudinal (front to back) axis, via the motor 29. This allows the opening 55 to be moved from a position above the level of the liquid in the chamber 17, to a lower position, where liquid can drain out through the opening 55. In an embodiment where the chamber 17 pivots, but does not spin or rotate, the supply line(s) 33 can be provided with sufficient slack to allow it to follow the pivoting movement of the chamber 17, and no rotary coupling 37 or other fluid delivery techniques are needed.

During an immersion process, fluid is provided into the chamber 17 until the workpieces are preferably completely immersed. The chamber 17 is positioned so that the opening 55 is near the top of the chamber as shown in FIG. 1, preventing liquid from draining out of the chamber 17. The rotor drive motor 41 may then spin the rotor 39 and workpieces 15 within the process fluid. This technique provides mixing and fluid movement over the workpieces 15, via relative movement between the fluid and the workpieces. The spin speed may be low, to avoid excessive splashing and turbulence. For some applications, both the rotor 39 and chamber 17 may remain still, with the workpieces immersed in the still process fluid contained in the chamber 17, for a desired time interval.

At an appropriate time during processing, to remove liquid, the chamber 17 is pivoted by the chamber drive 29, so that the opening 55 is at or below the level of the liquid 21. This allows the fluid to overflow or drain out through the opening 55 in the cylindrical sidewall of the inner process chamber 17, as shown in FIG. 3. The opening 55 is gradually moved down, preferably in a controlled manner, by continuing to pivot the chamber 17, to remove fluid a controlled rate. The liquid removed from the inner chamber flows into the outer chamber 19, where it is temporarily held, or optionally purged through and out of the outer chamber 30 via the port(s) 51.

With the liquid removed (or if no immersion steps are performed), the workpieces 15 are in the clean ambient gas or air environment within the chamber 17. Further process steps may then be performed. For example, the workpieces 15 may be cleaned by spraying them with a cleaning liquid (e.g., water). A gas, which is optionally heated, may then be sprayed onto the workpieces via the nozzles 31, with or without, rotating or pivoting the chamber 17 (and the nozzles 31 on the chamber 17), and with or without spinning the rotor holding workpieces, or both. To provide centrifugal liquid removal, the rotor 31 may be rotated at higher speeds.

For sequential processing steps, different liquid, gas, or vapor (collectively referred to here as "fluids") media may be applied to the workpieces from a fluid supply source 81, by immersion within a liquid gas or vapor, spraying, or other application. Rinsing and/or cleaning may be performed in between processing steps. However, the workpieces can remain within the chamber 17 at all times, reducing the potential for contamination.

The removal of the process fluids 21 from the inner process chamber 17 may alternatively be accomplished by allowing the fluids 21 to escape through a switched drain 61 in the inner process chamber 17, generally at a position opposite from the drain edge 57. The drain 61 may be switched via external magnetic influence, or via a pneumatic or hydraulic or electrical control line on or in the chamber 17, similar to the fluid line 33.

For processing workpieces by immersion, a continuously refreshed bath of liquid may be provided in the inner process chamber 17, while simultaneously and continuously draining out over the drain edge 57 in the sidewall, as the chamber 17 pivots counterclockwise in FIGS. 1 and 3. For some applications, the process liquid level in the chamber 17 may only cover a fraction of the workpieces. The workpieces can then be rotated in the rotor 39, so that all surfaces of the workpieces are at least momentarily immersed.

In any of the above embodiments or methods, the workpieces can be rotated in the rotor, to provide uniform distribution of the process fluid.

In a process for removing liquid from workpieces, a surface tension gradient lowering process can be used. A rinsing fluid, such as de-ionized water is introduced into the inner process chamber 17 to remove any remaining process chemicals. A gas, such as nitrogen, and an organic vapor, such as isopropyl alcohol, is then introduced via the manifold 35, or via a second similar manifold, to facilitate surface tension gradient removal of the rinsing fluid from the workpiece surfaces.

Referring back to FIG. 1, the rinsing liquid 21 is removed using the organic vapor which reduces surface tension at the liquid-gas interface 65. Via surface tension effects, the rinsing liquid 21 can be made to move from the interface region 65 down to the bulk of the rinsing liquid 21.

Therefore, through slow, controlled rotation of the inner process chamber 17, the rinsing fluid level can be lowered, removing the rinsing fluid 21 and the contaminants that may reside on the surface of the rinsing fluid. This method removes liquid from the workpieces 15 by allowing the surface tension gradient induced by the organic vapor to be maintained at the surface of the workpieces 15 as the rinsing liquid recedes. A suction manifold 67 may be provided adjacent to the drain edge 57, to draw off the surface of the liquid in the chamber 17.

During the process of removing the rinsing fluid from the inner process chamber 17, fresh rinsing fluid can be introduced into the inner process chamber 40 while the process chamber is pivoting to drain off fluid. The constant inflow of fresh liquid causes overflow, with the surface of the liquid flowing towards the drain slot. This allows for removal of particles and accumulated contaminants which may result from the cleaning and rinsing process, and which tend to be at the fluid surface.

The outer containment chamber 19 can be purged with a gas or vapor via a purge gas source 83 connected to a purge port 87, to maintain a desired environment. Such a gas may be nitrogen, argon, or a vapor such as hydrofluoric acid (HF) or a combination thereof. Similarly, gas or vapor(s) can be introduced in the inner process chamber 17 to provide a controlled environment.

Sonic energy may be applied to the workpieces via a transducer 75 (such as a megasonic or ultrasonic transducer) in or on the inner chamber, as shown in FIG. 1. The transducer 75 is positioned to transmit sonic energy through liquid in the inner chamber, to the workpieces immersed in the liquid. The sonic transducer may also be provided on the rotor, or in contact with the workpieces held by the rotor. Different types of opening, transducers may be used alone or in combination with each other. The sonic transducer 75 is powered via wires running on or through the inner chamber 17, optionally to slip rings at the back end of the apparatus 11, or via wires on the rotor 39.

Figure 5:
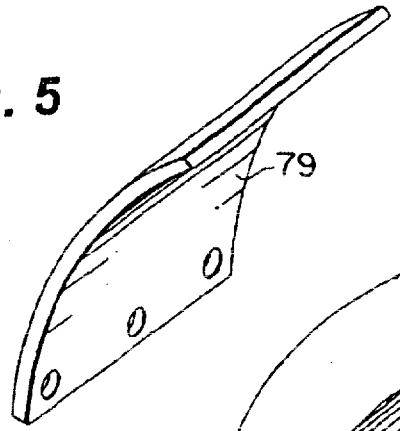
FIG. 5 is a perspective view of a removable cover plate for use with the apparatus of FIGS. 1–3.

In another embodiment, the apparatus is the same as described above in connection with FIGS. 1–3, except that the chamber 17 has no opening 55. Rather, the inner chamber has continuous cylindrical sidewalls, so that it can be closed off and sealed by the door 47. In addition, the fluid supply line 33 connects to the outlets or nozzles in the inner chamber via the rotary fluid coupling 37. The rotary fluid coupling allows the inner chamber to rotate (not just e.g., 100° for draining liquid, but 360° plus, continuously) while it is supplied with fluid. A similar rotary connection (preferably electrical or pneumatic) links the switched drain opening 61 in the inner chamber 17, to a controller. With this design, the inner chamber 17 is closed off, (and preferably sealed off) from even the outer chamber 19. Consequently, contamination is further avoided. The outer chamber 19 can then be omitted. The embodiment having the drain opening 55 may be converted to the closed embodiment by installing a sidewall panel 79 shown in FIG. 5 over the opening 55.

For certain process steps, the workpieces 15 in the holder or rotor 39 can remain stationary, while the chamber 17 spins around them. Alternatively, both the chamber 17 and workpieces 15 in the rotor 39 may rotate or spin. Still further, the rotor 39 may be configured as a holder simply attached to a fixed (non-rotating) rear structure, in a design where the workpieces 15 remain stationary at all times, and the chamber 17 rotates around them (e.g., while draining liquid or spraying or otherwise applying process media onto the workpieces). This closed chamber embodiment may also perform immersion processing. However, as there is no opening 55, liquid removal occurs by opening the drain 61, with the chamber positioned so that the drain 61 is at a low point.

Thus, while several embodiments have been shown and described, various changes and substitutions may of course be made, without departing from the spirit and scope of the invention. The invention, therefore, should not be limited, except by the following claims, and their equivalents.

What is claimed is:

1. A system of processing a workpiece, comprising:

a containment chamber;

a process chamber within the containment chamber and having a drain opening;

a process chamber driver linked to the process chamber, for pivoting the process chamber, to drain liquid out of the process chamber, at a controlled rate; and a workpiece holder within the process chamber.

2. The system of claim 1 further including a sonic transducer in the process chamber.

3. The system of claim 1 further including a removable door on the process chamber.

4. The system of claim 1 where the process chamber driver is linked to the process chamber with a magnetic coupling.

5. The system of claim 1 wherein the process chamber has a cylindrical side wall, and the drain opening is in the cylindrical sidewall.

6. The system of claim 1 wherein the process chamber is pivotable from a first position, where the process chamber can hold liquid at a level at least partially immersing a workpiece held in the workpiece holder, to a second position where liquid within the process chamber is able to drain out, through the opening, to a level entirely below the workpiece.

7. The system of claim 6 further comprising a fluid supply system including a fluid supply line extending into the process chamber.

8. The system of claim 7 further comprising at least one spray nozzle joined to the fluid supply line.

9. The system of claim 7 further comprising at least one of a process liquid source, a process gas source, and a process vapor source, connected into the fluid supply system.

10. The system of claim 7 wherein the fluid supply line pivots with the process chamber.

11. The system of claim 1 further comprising a workpiece holder extender, for moving the workpiece holder out of the process chamber, for loading and unloading workpieces, and moving the workpiece holder into the process chamber, for processing workpieces.

12. The system of claim 1 where the process chamber has cylindrical sidewalls and is pivotable about an axis parallel to the cylindrical sidewalls.

13. The system of claim 1 further comprising combs on the workpiece holder.

14. A system for processing a workpiece, comprising;

an outer chamber;

an inner chamber rotatably supported within the outer chamber;

an inner chamber driver for rotating the inner chamber;

a rotor within the inner chamber; and a rotor driver for rotating the rotor.

15. The system of claim 14 further including a fluid delivery system having a fluid delivery line extending into the inner chamber.

16. The system of claim 15 further comprising at least one opening in the inner chamber joined to the fluid delivery line.

17. The system of claim 16, the at least one opening comprises at least one spray nozzle.

18. The system of claim 14 further including an inner door on the inner chamber, and an outer door on the outer chamber.

19. The system of claim 14 further including a drain opening in the inner chamber leading out to the outer chamber.

20. The system of claim 14 further including a removable sidewall panel in the inner chamber.

21. The system of claim 14 the inner chamber and the outer chamber are cylindrical.

22. The system of claim 21 where the rotor is cylindrical and concentric with the inner chamber and the outer chamber.

23. The system of claim 14 further comprising a purge gas system connected into at least one of the outer chamber and the inner chamber.

24. A system of processing a workpiece, comprising:

a containment chamber;

a process chamber within the containment chamber and having a drain opening;

a process chamber driver linked to the process chamber, for pivoting the process chamber, to drain liquid out of the process chamber, at a controlled rate;

a workpiece holder within the process chamber; and a workpiece holder driver for rotating the workpiece holder.

25. The system of claim 24 where the workpiece holder driver is linked to the workpiece holder by a magnetic coupling.

26. A system of processing a batch of flat workpieces, comprising:

a liquid tight process chamber capable of holding a bath of liquid;

a drain opening in the process chamber;

a process chamber driver linked to the process chamber, for pivoting the process chamber to a position where the liquid can drain out of the process chamber through the drain opening, at a controlled rate; and a workpiece holder within the process chamber, for holding the batch of flat workpieces in a vertically upright array.

27. The system of claim 26 with the process chamber pivotable about a horizontal axis.

28. The system of claim 26 further including a sonic transducer in the process chamber.

29. The system of claim 26 wherein the process chamber is pivotable from a first position, where the process chamber can hold liquid at a level at least partially immersing the workpiece holder, to a second position where liquid within the process chamber is able to drain out, through the opening, to a lever entirely below the workpieces.

30. The system of claim 26 wherein the drain opening comprises a slot in the process chamber.

31. The system of claim 30 wherein the drain slot extends parallel to an axis of rotation of the process chamber.

32. The system of claim 26 wherein the process chamber is linked to the process chamber driver by a magnetic coupling.

33. The system of claim 26 wherein the drain opening comprises a drain port which is switchable between a closed position, for immersing the workpieces, and an open position, for draining liquid out of the process chamber.

34. A system for rinsing and drying a batch of flat workpieces, comprising:

a process chamber having a drain opening;

a process chamber driver for pivoting the process chamber, to drain liquid out of the process chamber through the drain opening, at a controlled rate;

a workpiece holder within the process chamber, for holding the batch of flat workpieces, a rinsing liquid source connecting into the process chamber; and an organic vapor source connecting into the process chamber.

35. The system of claim 34 wherein the workpiece holder comprises a rotor for spinning the workpieces within the process chamber.

36. The system of claim 34 further including a sonic transducer associated with the process chamber.

37. The system of claim 34 comprising a suction manifold adjacent to the drain opening.

* * * * *